US008069715B2

(12) United States Patent
Keller

(10) Patent No.: US 8,069,715 B2
(45) Date of Patent: Dec. 6, 2011

(54) VADOSE ZONE PORE LIQUID SAMPLING SYSTEM

(76) Inventor: Carl Keller, Santa Fe, NM (US)

( * ) Notice: Subject to any disclaimer, the term of this patent is extended or adjusted under 35 U.S.C. 154(b) by 553 days.

(21) Appl. No.: 12/287,981

(22) Filed: Oct. 15, 2008

(65) Prior Publication Data

US 2009/0095066 A1 Apr. 16, 2009

Related U.S. Application Data

(60) Provisional application No. 60/999,002, filed on Oct. 15, 2007.

(51) Int. Cl.
*E21B 49/08* (2006.01)

(52) U.S. Cl. ..... 73/152.28; 166/264

(58) Field of Classification Search ..... 73/152.28, 73/152.39; 166/207, 264
See application file for complete search history.

(56) References Cited

U.S. PATENT DOCUMENTS

| | | | | | |
|---|---|---|---|---|---|
| 4,778,553 | A | | 10/1988 | Wood | |
| 5,176,207 | A | | 1/1993 | Keller | |
| 5,246,862 | A | | 9/1993 | Grey et al. | |
| 5,377,754 | A | | 1/1995 | Keller | |
| 5,458,747 | A | * | 10/1995 | Marks et al. | 205/702 |
| 5,725,055 | A | * | 3/1998 | Schirmer et al. | 166/264 |
| 5,803,666 | A | | 9/1998 | Keller | |
| 5,804,743 | A | | 9/1998 | Vroblesky et al. | |
| 5,853,049 | A | | 12/1998 | Keller | |
| 6,026,900 | A | | 2/2000 | Keller | |
| 6,109,828 | A | | 8/2000 | Keller | |
| 6,244,846 | B1 | | 6/2001 | Keller | |
| 6,283,209 | B1 | | 9/2001 | Keller | |
| 6,298,920 | B1 | | 10/2001 | Keller | |
| 6,910,374 | B2 | | 6/2005 | Keller | |
| 7,281,422 | B2 | | 10/2007 | Keller | |
| 7,334,486 | B1 | | 2/2008 | Klammler et al. | |
| 7,753,120 | B2 | * | 7/2010 | Keller | 166/264 |
| 7,841,405 | B2 | * | 11/2010 | Keller | 166/264 |
| 2004/0065438 | A1 | | 4/2004 | Keller | |
| 2005/0172710 | A1 | | 8/2005 | Keller | |
| 2007/0260439 | A1 | | 11/2007 | Keller | |

OTHER PUBLICATIONS

Keller, C., et al., "Evaluation of the Potential Utility of Fluid Absorber Mapping . . . "; Proc. of the 7th Nat'l Outdoor Action Conf.; May 25, 1993; pp. 421-435; USA.

Keller, C., Improved Spatial Resolution in Vertical and Horizontal Holes . . . ; Remediation of Hazardous Waste Contaminated Soils; 1994; pp. 513-541; Marcel Dekker, Inc.; USA.

(Continued)

*Primary Examiner* — John Fitzgerald
(74) *Attorney, Agent, or Firm* — Rod D. Baker

(57) ABSTRACT

A method and apparatus for collection of pore water samples from a subsurface geologic formation, especially a vadose zone formation having high capillary tension. The method consists of injection of a fluid with known tracer concentrations therein into the formation. The injected displacement fluid develops a wetting front which carries with it the ambient pore water. The mixture of pore water and tracer-bearing displacement fluid is absorbed by a collection system, such as an absorbent member or pumping system. The injection and collection system are attached to a sealing borehole liner for emplacement in a borehole in the formation, and for other functions. Water samples collected in the collector system may be recovered by inversion of the liner, or alternatively by pumping. Samples thus removed from the borehole may be evaluated for chemicals, such as contaminants. The use of the tracer permits pore water characteristics to be distinguished from the motivating displacement fluid. Apparatuses for performing the foregoing functions are described.

24 Claims, 5 Drawing Sheets

OTHER PUBLICATIONS

Cherry, J. A., et al.; "A New Depth-Discrete Multilevel Monitoring Approach for Fractured Rock"; Ground Water Monit. & Remed.; 2007; pp. 57-70; vol. 27, No. 2; USA.

* cited by examiner

FIG. 5A
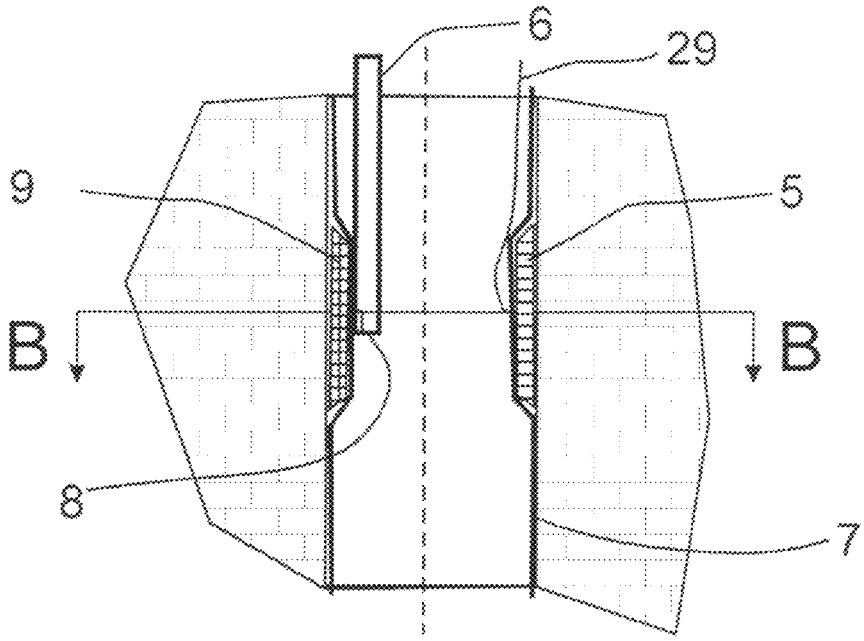
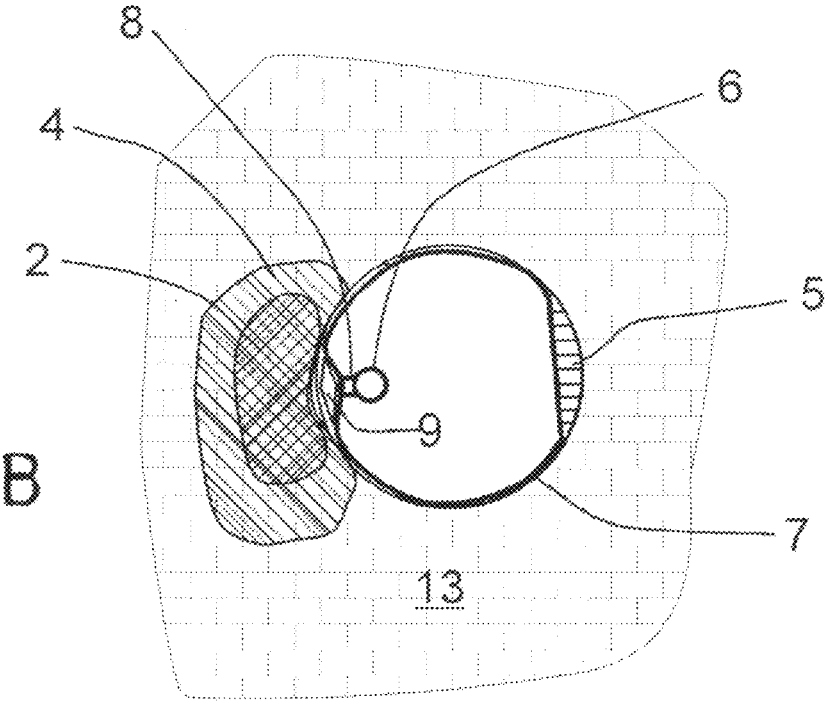
FIG. 5B

VADOSE ZONE PORE LIQUID SAMPLING SYSTEM

CROSS-REFERENCE TO RELATED APPLICATIONS

This application claims the benefit of the filing of U.S. Provisional Patent Application Ser. No. 60/999,002, filed on Oct. 15, 2007, and the specification thereof is incorporated herein by reference.

BACKGROUND OF THE INVENTION

1. Field of the Invention

The present disclosure relates to subsurface geohydrological sampling, and specifically to a method and apparatus for obtaining vadose zone pore liquid samples from the vadose zone beneath the surface of the ground.

2. Background Information

The subsurface of the earth may become contaminated with natural, or more commonly, made-made pollutants. Such contamination may occur in the vadose zone, which is that portion of the subsurface above the natural water table. In the fields of detecting, monitoring, and remediating sub-surface conditions, including the scope and character of contamination, it is often useful to obtain a pore liquid sample from the unsaturated zone of geologic formations to assess the concentration of contaminants of various kinds in the in situ pore fluids. This is usually done by collection of a core sample of the geologic material, or an extraction of the pore liquids using a variety of techniques such as suction lysimeters. However, when a borehole in the unsaturated medium is unstable and the sediments are filled with cobbles, it is often not possible to obtain a core sample of the in situ pore fluids. In addition, the coring process is very expensive compared to the normal drilling of the borehole. Also, for relatively dry geologic media suction, lysimeters are unable to obtain a liquid sample. An unmet need remains for simple and effective methods and means for sampling the pore liquids within the vadose zone.

My previous U.S. Pat. No. 5,176,207, which is incorporated herein by reference, shows the use of a flexible tubular liner with an absorbent outer covering for the collection of pore liquid samples from subsurface boreholes. The liner is installed by eversion down the borehole. The interior fluid pressure of the liner is increased to dilate the liner, thus urging the outer absorber against the borehole wall to allow the absorber to wick the pore liquids from the borehole wall material (i.e., the geologic formation). The absorber continues to absorb the pore liquid until the capillary tension in the absorber equals the capillary tension in the geologic medium. The amount of pore liquids that can be absorbed in the absorbent covering is limited significantly by the capillary tension of the formation. In relatively dry geologic formations (including many vadose zone formations), the method and apparatus of U.S. Pat. No. 5,176,207 absorbs little pore fluid into the outer absorbent layer.

SUMMARY OF THE INVENTION

Disclosure of the Invention

There are disclosed a method and apparatus for collection of pore water samples from a subsurface geologic formation, especially a vadose zone formation having high capillary tension. The method consists of injection of a fluid with known tracer concentrations therein into the formation. The injected displacement fluid develops a wetting front which carries with it the ambient pore water. The mixture of pore water and tracer-bearing displacement fluid is absorbed by a collection system, such as an absorbent member or pumping system. The injection and collection system are attached to a sealing borehole liner for emplacement in a borehole in the formation, and for other functions. Water samples collected in the collector system may be recovered by inversion of the liner, or alternatively by pumping. Samples thus removed from the borehole may be evaluated for chemicals, such as contaminants. The use of the tracer permits pore water characteristics to be distinguished from the motivating displacement fluid. Apparatuses for performing the foregoing functions are described.

BRIEF DESCRIPTION OF THE DRAWINGS

The accompanying drawings, which are incorporated into and form a part of this specification, illustrate several embodiments of the present invention and, together with the description, serve to explain the principles of the invention. The drawings are only for the purpose of illustrating a preferred embodiment of the invention and are not to be construed as limiting the invention. In the drawings:

FIG. 5A is a vertical sectional view of an embodiment of the apparatus of the present disclosure installed in a subsurface borehole; and FIG. 5B is radial (lateral) sectional view, taken along section line B-B of FIG. 5A, showing an apparatus according to the present disclosure and illustrating an alternative possible flow geometry.

DESCRIPTION OF THE PREFERRED EMBODIMENTS

Best Modes for Carrying Out the Invention

There is provided a method and apparatus employing an absorbent collector and permitting the sampling of subsurface pore fluids from unsaturated geologic formations with capillary tensions so high that neither suction lysimeters nor previously known simple absorbent collectors can be used satisfactorily. The present disclosure pertains to an apparatus and process in which a flexible liner is installed in a bore hole with an absorbent outer layer or component. According to this disclosure, a source of water with a prescribed tracer concentration is introduced into the formation near the absorbent component. The water source can be a port in the liner, the port being in fluid communication with a tube interior to the liner and which extends to the surface. The tube is used to inject the tracer-bearing water into the medium surrounding the borehole to develop a wetting front of high saturation in the unsaturated material. The injected water entrains the original ambient pore fluid in the surrounding medium; as the wetting front expands with continued slow water injection, the wetting front intersects the absorbent component to be wicked into it Due to the high saturation in the wetting front, it has a very low capillary tension. This resultant low capillary tension allows relatively increased amounts of pore fluid to be wicked into the absorbent component. Another advantage of the method is that the wetting front tends to displace the ambient pore fluid, so that the leading edge of the wetting front—which is first absorbed into the absorbent component—contains predominantly the original ambient pore fluid. An inflated sealing liner element of the apparatus installed in the borehole forces the water injected according to the method to travel through the surrounding geologic media. The sealing liner also functions as the apparatus installation and recovery apparatus, and offers other advantages to be further described herein.

The tracer in the injected water (or other suitable injected fluid) permits an assessment of what fraction of the fluid absorbed into the absorber component is comprised of injected fluid, versus the original ambient pore fluid. Using that information, a chemical analysis of the absorbed liquid yields the in situ concentration of the pore fluid components in the surrounding geologic formation.

Figure 1:
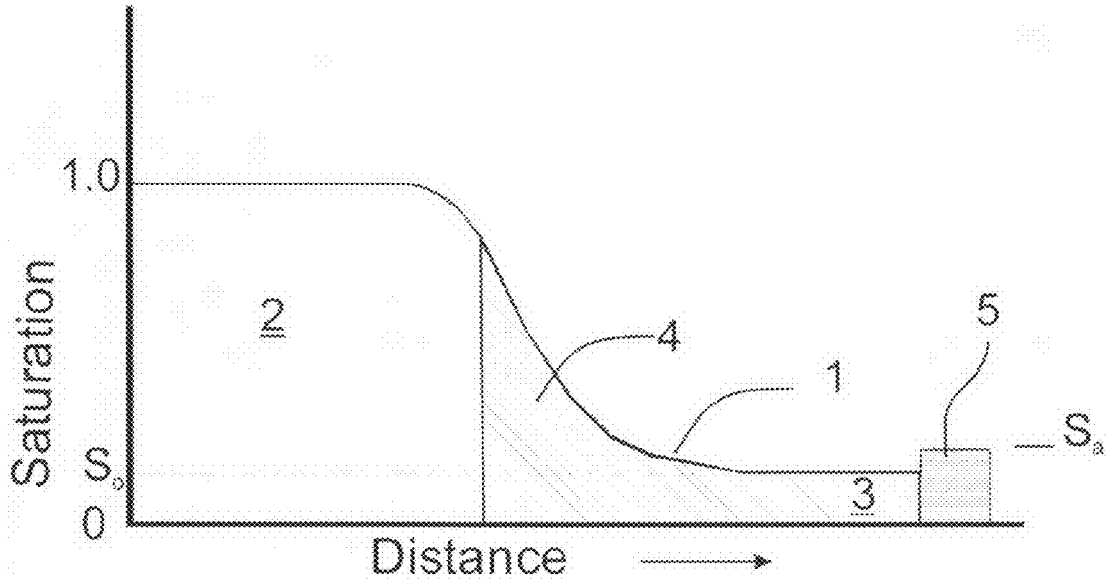
FIG. 1 is a graph of saturation versus distance, showing the normal saturation distribution in a porous material with water injection at the origin.

Attention is invited to FIG. 1, which depicts graphically the development of a wetting front moving through the media surrounding a subsurface borehole. The addition of water to a partially saturated medium causes the development of a wetting front 1 between the high saturation region 2 and the original saturation $S_o$, region 3 of the surrounding media. The injected water tends to displace the original pore fluid for miscible fluids (e.g., water) rather than simply flowing past the originally ambient water, thereby developing an elevated saturation front 4 of the original pore liquid.

The foregoing fluid behavior of the pore liquids in an unsaturated medium, such as a subsurface vadose zone, is exploited by emplacing a suitable fluid injection source in the proximity of a suitable absorber; the injected water urges the original ambient pore water to the absorber. This process permits a larger volume of the original pore water to be collected than would be obtained by merely placing an absorber directly against the surrounding geologic formation. The reduced capillary tension of the wetting front ultimately allows relatively more water to be absorbed (for later analysis) because the absorber wicks fluid from the formation until the capillary tension of the absorber approaches substantial equilibrium with the surrounding formation.

Continued reference is made to FIG. 1. An absorber 5 of saturation level $S_a$ and having high capillary tension is placed in the path of the advancing wetting front 1. The absorber 5 only wicks pore fluid from the surrounding media at initial saturation $S_o$ if the capillary tension of the absorber exceeds that of the media. However, when the wetting front 4 with a relatively low capillary tension arrives at the absorber 5, the absorber wicks first the fluid in the wetting front 1 and, if there is any capacity left, the fluid 4 behind the wetting front. If a suitable tracer has been introduced into the injected water 2, the quantity of injected water taken up into the absorber 5 can be determined relative to the amount of original pore water. By thus mathematically controlling for the absorbed injected water, the constituents in the original ambient pore water thereby can be determined from the fluid absorbed in the absorber 5.

As further described herein below, the forgoing process can be used subsurface in geologic media by emplacing a suitable injection source in the proximity of an absorber to allow the original pore water to be urged into the absorber by the injected water. This allows a larger sample of the original pore water than would be obtained by simply urging an absorber against the formation, because the capillary tension of the wetting front is much lower than for the original saturation. This lower capillary tension of the wetting front permits much more water to be absorbed, because the absorber wicks fluid from the formation until the capillary tension of the absorber approaches equilibrium with the formation.

Figure 2:
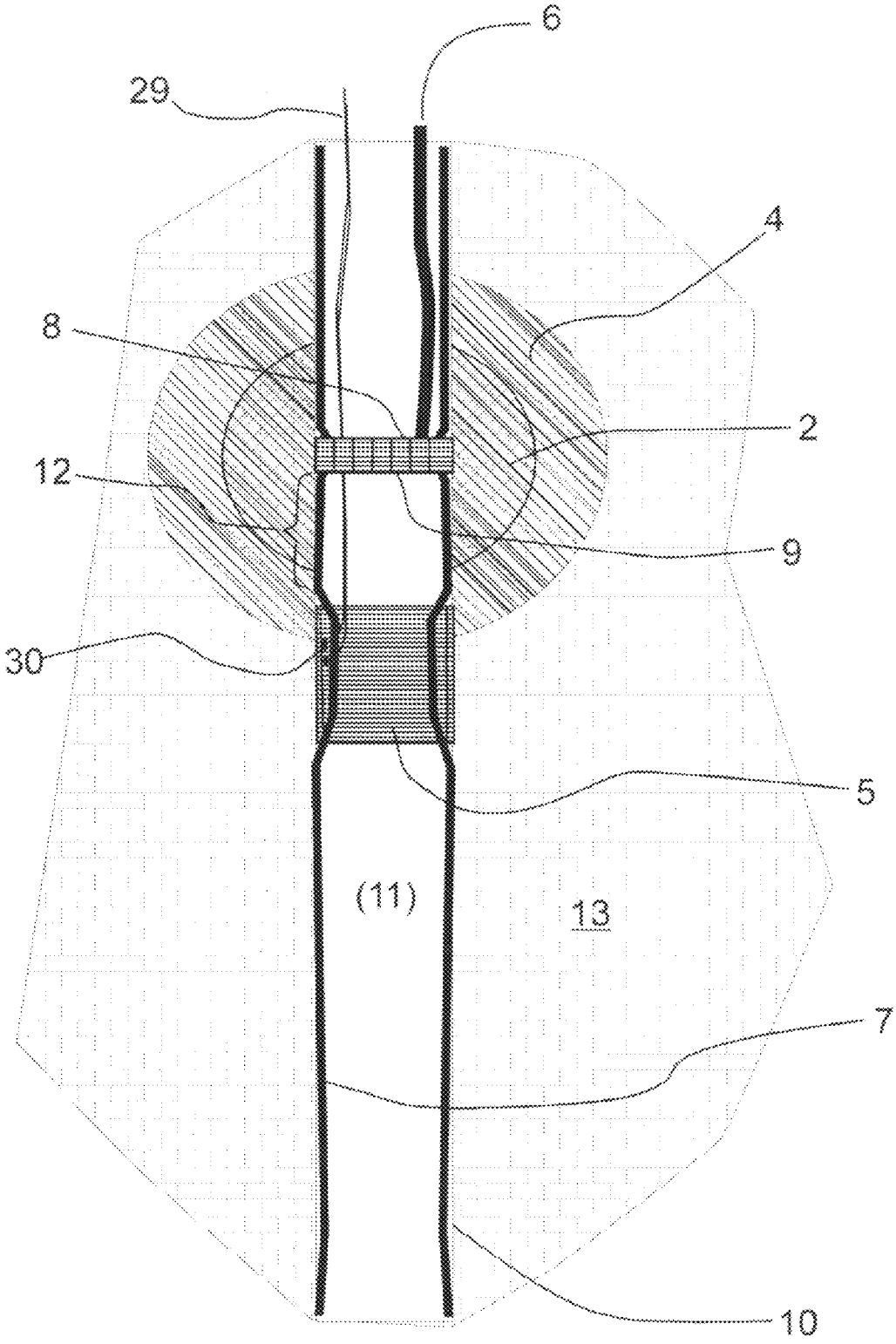
FIG. 2 is a vertical sectional view of an apparatus according to the present disclosure situated in a subsurface borehole, illustrating the geometry of the injection annulus and the absorber annulus on the exterior of the liner, also showing the wetting front contact with the absorber component of the apparatus.

FIG. 2 illustrates that one possible mode of installation of an injection tube 6, connected to a mesh, for uniform distribution of the injected water according to the present disclosure. The impermeable flexible liner 7 is emplaced in the borehole by lowering or everting it into position, for example as taught generally by my U.S. Pat. No. 6,910,374. A suitable interior driving fluid 11 (e.g., air or water) everts the liner 7 into the borehole. The pressure of the interior fluid 11 urges the injection system (including the injection tube 6 and injection port 8), the absorber 5, and the liner 7 against the borehole wall 10. The absorber 5 preferably may be an annular pad running around the circumference of the liner 7, or in alternative embodiments may be an absorbent patch or layer that covers a selected arcuate segment of the liner exterior. The pressurized liner 7 also seals the borehole relative to the surrounding geologic formation 13. The tubing 6 is attached within the interior of the liner 7. The distal end of the tube 6 is in fluid communication with a port 8 defined through the liner 7. The port 8 through the liner is situated behind an exterior screen or mesh spacer 9 attached to the outside surface of the liner 7, and thus between the liner and the borehole wall 10. The spacer 9 may be fluid communication with a port 8 defined through the liner 7. The port 8 through the liner is situated behind an exterior screen or mesh spacer 9 attached to the outside surface of the liner 7, and thus between the liner and the borehole wall 10. The spacer 9 may be annular so to surround the periphery of the liner at a particular elevation in the borehole, and is located near above the absorber component 5, which also is attached to the outside surface of the liner 7.

An injected displacement fluid, for example clean water, is injected from above the ground surface, via the tube 6, and into the apparatus. The exterior mesh spacer 9 (e.g., a screen) distributes the flowing injected fluid uniformly around the exterior periphery of the liner 7 to generate an annular source geometry, surrounding the liner circumference, for the injected displacement fluid. There is a sealed vertical interval 12 between the mesh spacer 9 and the absorber 5, so to force the injected water exiting the port 8 to flow through the geologic formation 13 (rather than through the borehole) and into the absorber 5. The injected water pressure is regulated to be less than the interior liner pressure (due to the interior fluid 11) to preserve the seal of the liner 7 against the borehole wall 10. The introduction of the injection fluid 2 into the formation 13 creates a moving wetting front 4. The wetting front 4 pushes, ahead and with it, the ambient pore liquids originally present in the formation 13. As the wetting front 4 propagates outward thorough the formation 13, it eventually encounters the absorber 5. Ambient pore fluid from within the formation 13 and pushed ahead of the displacement fluid 2 and toward the absorber 5 is first absorbed into the absorber, followed by a mixture of original pore liquid and tracer-bearing injection water.

The absorber 5 wicks the wetting front 4 until the pore space of the absorber substantially obtains capillary tension equilibrium with the pore space of the formation 13. The absorber 5 with pore fluids absorbed therein then is recovered by removal of the liner 7 from the borehole. Retrieval of the liner 7 to the surface preferably is by inversion of the liner to prevent contact of the absorber 5 with other portions of the borehole wall 10.

Because the absorption of the wetting front 4 by the absorber 5 is time dependent, the absorption process preferably is monitored to determine when an adequate sample has been absorbed, in order to know when to terminate the injection of fluid. A pair of wires 29 disposed down the borehole within the interior of the liner 7 permits the monitoring at the surface of the resistance between two metal contacts 30 disposed on or in the absorber 5. (The contacts 30, trailing the wire pair 29, are carried down-hole embedded in the liner 7 when the absorber 5 is placed during the initial eversion of the liner 7.) As the in situ pore liquid is wicked into the absorber 5, the electrical resistance between the contacts 30 decreases. When the monitored resistance is determined to no longer be decreasing, the absorber 5 is removed with the liner 7 from the borehole 10 for analysis of the absorbed fluids.

Thus, by inflating the liner 7 with a suitable fluid 11 such as air or water, the liner urges the injection system 6, 8, 9 and absorber 5 against the borehole wall 10. The sealed interval 12 provided by the liner 7 between the injection port 8 and the absorber 5, prevents the injected water from flowing directly to the absorber. As mentioned, the injected water pressure is controlled to be less than the interior liner pressure to preserve the seal of the liner 7 against the borehole wall 10.

Figure 3:
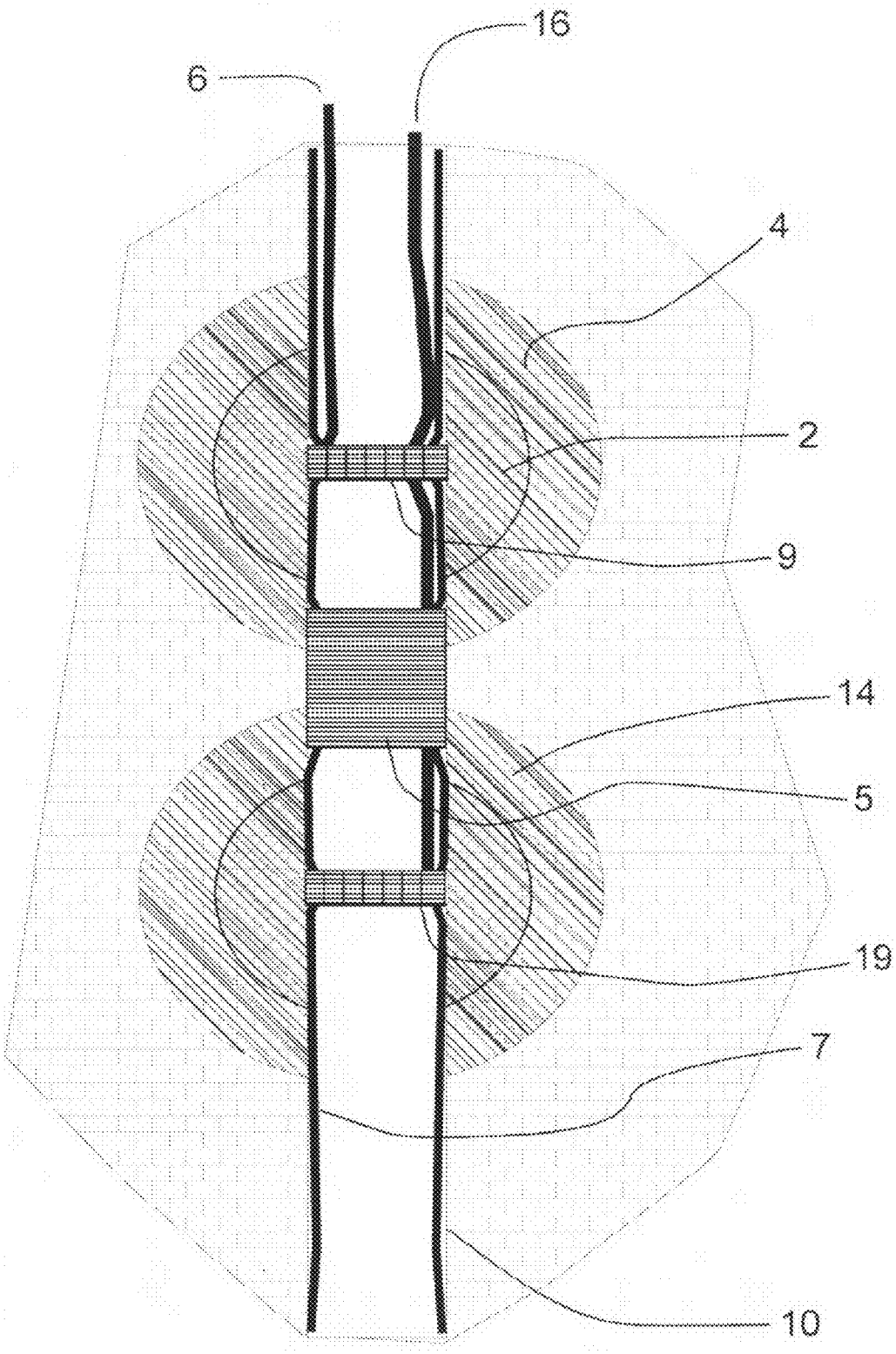
FIG. 3 is a vertical sectional view similar in some respects to the view of FIG. 2, depicting the addition of a second injection port and tube to displace the pore fluid to the absorber component, also showing two wetting fronts converging on the absorber component.

An alternative mode and means for practicing another embodiment of the invention, preferable in many applications, is shown in FIG. 3, in which like reference numerals identify like elements in FIG. 1. This alternative embodiment has a second injection port below, as well as above, the absorber 5. In this embodiment, there preferably is a first injection port in the immediate vicinity of a first or upper spacer 9 and a second injection port in the immediate vicinity of a second or lower spacer 19. As seen in FIG. 3, the collection system, such as an absorber 5, is situated between the two injection ports, and thus intermediate to the two spacers 9, 19. Displacement fluid is injected to the first injection port via the first injection tube 6, while displacement fluid similarly is injected to the second injection port via a second injection tube 16. (A person of ordinary skill in the art will readily recognize that both injection ports possibly could be supplied by a single injection tube (e.g., element 16) with any suitable means of dividing flow through the tube.) This geometry allows the development of two converging wetting fronts 4, 14 that propagate toward the absorber 5. Two wetting fronts 4, 14 converging from above and below the liquid collection system promote the wicking of an even larger volume of the original pore fluid into the collector, such as the absorber 5.

The foregoing means and methods for urging the natural pore fluids into an absorbent collection system may be used with a variety of other pore liquid collection systems for saturated media, by replacing the absorber 5 of the previously described embodiments with a water pumping system. Referring now to the disclosure of FIG. 4 (similar in some respects to the embodiment seen in FIG. 3), a requirement of these alternative embodiments is that the wetting front 4 be fully saturated and that the displacing fluid be free to flow under normal gravitational forces, or induced pressure gradients, to a collector assembly 20, 21. The convergent wetting fronts 4, 14 foster full saturation of the medium at the central sampling port 21 situated behind (i.e., radially inward from) a mesh spacer 20, which allows liquids to flow through the mesh 20 into the port 21. From the port 21, the collected liquids are transmitted via an intermediate tube 22, which is interior to the liner 7, and to a suitable pumping system 23. The pumping system 23 pumps the collected liquids through a pump tube 24 to the Earth's surface for analysis.

The pumping system 23 can be any of several known and suitable types, but a typical positive gas displacement system with two check valves is often used with the liner system. For nearly saturated conditions, a vacuum pump 27 at the top of the pump tube 24 can apply a partial vacuum to the pumping system 23 via the pump tube, which allows water to be drawn into the pumping system even if the medium at a wetting front 4 or 14 is not fully saturated. If a fully saturated condition is obtained, pore water nevertheless could be collected using this process by means of adjacent slotted well screens in a cased hole; slotted well screens, well-known in the art of subsurface bore hole installation and use, replace the mesh spacer 20 in the unsaturated zone—which is not usually possible with an absorber alone. Thus, the scope of invention includes an apparatus wherein a well case screen is employed in lieu of the permeable mesh spacer 20.

The foregoing flexible liner sampling system can be emplaced using the methods disclosed in my U.S. Pat. No. 6,298,920, entitled "Method and Apparatus for Removing a Rigid Liner from Within a Cylindrical Cavity," teaching the emplacement of a flexible liner through rigid casing. Such an emplacement method includes disposing the liner and absorbent member down the borehole by: disposing a rigid casing liner down the borehole, placing the flexible liner down the interior of the casing liner, adding water or air into an annular space between the rigid casing liner and the flexible liner until an annular fluid pressure equals an interior pressure of the flexible liner, lifting the rigid casing liner from the borehole, leaving the flexible liner in place, and then allowing the interior pressure in the flexible liner to force the liner against the borehole wall, thereby pressing the absorbent member against the borehole wall. In this application, the air is used for the liner emplacement, since any water addition would complicate the process intended.

Attention is invited to FIGS. 5A and 5B, illustrating yet another possible variation of the methods and apparatus of the present disclosure. In the embodiment of FIGS. 5A-B, a displacing fluid is injected, but recovery of pore liquids is accomplished using different flow and collector geometries. The liner 7 is emplaced in the borehole, and the injection tube 6 is within the liner interior.

Referring jointly to FIGS. 5A and 5B, a discrete injection spacer mesh 9 is located on one side of the liner 7 between the liner and the surrounding formation 13. As best seen in FIG. 5B, the spacer mesh 9 subtends only a fraction of the circumferential periphery of the borehole and liner 7. The absorbent absorber 5 is situated on the diametrically opposite side of the liner 7. The injection tube 6 is in fluid communication, via a radial port 8 passing through the liner 7, with the volume created by the mesh spacer 9 between the liner and the formation 13 defining the water source region. Displacing fluid 2 injected down the injection tube 6 thus initially enters the adjacent geologic formation 13 in the vicinity of the mesh spacer 9, as suggested in FIG. 5B. Continued injection of displacing fluid 2 causes the wetting front 4 (pushing and bearing ambient pore liquids) to move circumferentially around the periphery of the borehole, as indicated by the directional arrows of FIG. 5B, toward the absorber 5. Hence the wetting front 4 travels azimuthally around the borehole through the formation, and ultimately arrives at the absorber from two opposite lateral directions. The degree of liquid wicking into the absorber 5 is monitored electrically via the wire leads 29, as described previously.

Accordingly, there is provided hereby a method for evaluating pore liquids in a geologic formation 13 around a borehole 10. Succinctly summarized, the method features these basic steps: providing at least one collection system 5 (or 20, 21, 23) upon a flexible liner 7; disposing the flexible liner 7 and collection system down the borehole 10; disposing at least one injection tube 6 down the borehole; injecting a displacement fluid (such as clean water) through the injection tube 6 and into the formation 10 around the borehole; creating with the displacement fluid 2 a wetting front 4 moving through the formation 13 to carry pore liquids to the collection system; allowing the collection system to collect liquids from the wetting front, including ambient pore liquids moved by or mixed with the displacement fluid; and evaluating the collected liquids for chemicals therein. The step of injecting a displacement fluid preferably includes the step of mixing a known concentration of an identifiable but inert tracer material with the displacement fluid prior to injecting the displacement fluid through the injection tube 6.

Preferably, the step of disposing the liner 7 and collection system down the borehole 10 includes the step of everting, with the pressure of a fluid, the flexible liner 7 down the borehole 10. In this method, the step of providing at least one collection system more specifically may be the attaching of an absorber 5, such as a carbon felt or other suitably absorbent pad or patch, to the liner 7. The absorber normally is attached to the liner prior to installation of the liner down the borehole, but must be in place prior to injection of the displacement fluid.

A more elaborate extension of the process includes the step of monitoring absorption of liquids into the absorber 5.

When the collection system features an absorber member 5, the method preferably has the additional steps of withdrawing the flexible liner 7 and absorber 5 from the borehole 10, and then evaluating (i.e., in the field above the borehole, or in an appropriate laboratory) the absorber 5 for liquids absorbed therein.

Disposing an injection tube 6 down the borehole 10 preferably includes the step of disposing the injection tube 6 within the interior of the liner, in which interior space the pressurizing fluid for everting the flexible liner is introduced. A first injection port 8 is provided as an aperture through the liner 7 and in fluid communication with the injection tube 6, and displacement fluid is injected through the first injection port into the surrounding geologic media 13. Preferably, a permeable spacer 9 is disposed between the liner 7 and the formation 13 substantially proximate to the port 8.

In one version of the method, the first injection port 8 (with an associated spacer 9) and the absorber 5 are located on approximately diametrically opposite sides of the liner 7. In this embodiment, injecting displacing fluid 2 through the first injection port causes the wetting front 4 to move circumferentially around the periphery of the borehole 10 toward the absorber 5. The wetting front 4 then moves around both sides of the borehole 10 to approach the absorber 5 from two different directions.

Yet another version of the method includes the added steps of providing a second injection port through the liner 7, locating the collection system 5 (or, in FIG. 4, elements 20, 21) between the first injection port and the second injection port, and injecting displacement fluid through the second injection port and into the formation 13, thus creating with the displacement fluid 2 a wetting front 4 moving through the formation to carry pore liquids to the collection system. This process permits the step of creating two wetting fronts 4, 14 converging toward the collection system. With this version of the method, the formation 13 is saturated; the step of locating the collection system includes the further steps of providing a permeable spacer 20 around the liner 7; defining a sampler port 21 through the liner 7 in the vicinity of the permeable spacer 20; placing a pumping system 23 in fluid communication with the sampler port 21; and pumping collected liquid out of the borehole 10 for evaluation. The permeable spacer 20 may be fashioned from a mesh, such as a plastic or metal screen of suitable fineness. In this process, the step of allowing the collection system to collect liquids involves allowing pore liquids to flow into the pumping system 23 via the sampler port 21.

Practicing the method also optionally may include providing a pump tube 24 having a top end for carrying collected liquid, and then applying a vacuum to the top end of the pump tube 24.

In conceptual parallel with the disclosed method, there also is disclosed hereby an apparatus for evaluating ambient pore liquids in a geologic formation 13 around a borehole 10. The basic apparatus has at least one collection system (element 5 of FIGS. 2 and 3, or including elements 20 and 21 in the embodiment of FIG. 4) upon a flexible liner 7 everted down the borehole 10; and tube means 6 (and optionally 16), disposed down the borehole for injecting a displacement fluid into the formation to create, with the displacement fluid, a wetting front 4 to carry pore liquids to the collection system. The collection system thus collects liquids from the wetting front 4, thereby allowing evaluation of the collected liquids for any chemicals therein. The liquids collected in the collection system include ambient pore liquids as well as displacement fluid; however, because the displacement fluid contains a tracer constituent, the pore liquids can be accurately tested and evaluated for contaminants or other selected chemicals therein despite its intermixture with the displacing fluid that carried the pore liquids to the collection system.

In embodiments of the apparatus depicted in FIGS. 2 and 3, at least one collection system is an absorber 5 on the liner 7. The absorber 5 is fabricated from materials known in the art for absorbing ambient subsurface liquids; the flexible liner 7 and absorber 5 can be withdrawn from the borehole 10 to permit evaluation of liquids (pore liquids and some quantity of displacement fluid) absorbed in the absorber.

The apparatus also preferably includes means for monitoring the absorption of liquids by the absorber 5. As seen in FIG. 2, such a means for monitoring absorption may include contacts 30 against the absorber 5 for measuring electrical resistance (due to changing saturation level of the absorber) between the contacts, and means for transmitting the measured resistance to the top of the borehole, above the surface of the ground. The means for transmitting may be conductive wire leads 29. Alternatively, transmitting means may be wireless, such as radio transmission.

The injection tube 6 preferably is disposed within the liner interior, usually in an interior sleeve welded to the surface of the liner. The apparatus preferably has a first injection port, through the liner 7 and in fluid communication with the injection tube 6, for injecting displacement fluid 2 into the formation 13. Normally, a spacer 9 is situated between the liner 7 and the formation 13, substantially proximate to the port.

As seen in FIGS. 5A and 5B, an alternative embodiment of the apparatus has the first injection port 8 and the absorber 5 located on approximately diametrically opposite sides of the liner 7, so that injecting displacing fluid through the first injection port causes the wetting front 4 to move circumferentially around the periphery of the borehole 10 toward the absorber 5. With this embodiment, the wetting front moves around both sides of the borehole 10 to approach the absorber 5 from two directions.

Another embodiment of the apparatus is seen in FIG. 3, and has a second injection port through the liner 7 for injecting displacement fluid at another separate location of the formation 13. Here the collection system is located between the first injection port and the second injection port. The collection system shown in FIG. 3 is an absorber 5, but it is immediately understood that the collection system of the embodiment of FIG. 3 alternatively could be the mesh spacer 21, sampler port 21 (and operatively associated pumping system 23) described with reference to FIG. 4. When this embodiment of the apparatus is operated, the wetting front moving through the formation 13 to carry pore liquids to the collection system is two distinct wetting fronts 4 and 14 converging toward the collection system (5 or 21).

Figure 4:
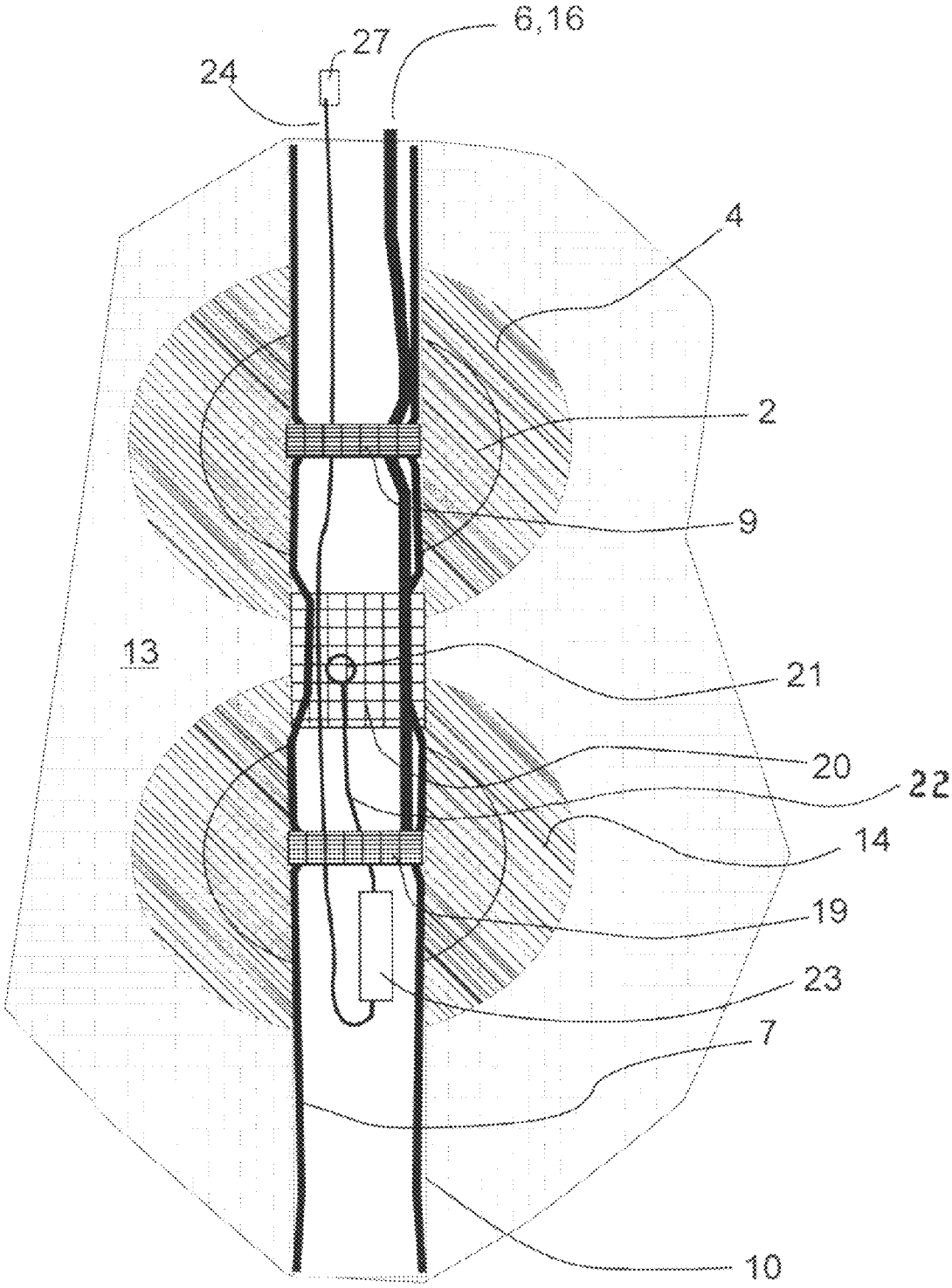
FIG. 4 is a vertical sectional view similar in many respects to the view of FIG. 3, but showing an alternative embodiment of the invention wherein the absorber component is replaced with a liquid collection and pumping system for use with a fully saturated wetting front.

In a formation saturated by the injection, there may be provided in the apparatus seen in FIG. 4 a permeable spacer 20 around the liner 7, a sampler port 21 defined completely through the liner in the vicinity of the permeable spacer, and a pumping system 23 in fluid communication with the sample port 21 for pumping collected liquid out of the formation 13 for evaluation. The pore liquids driven to the port 21 by the injected displacing fluid 2 flow to the pumping system 23 via the sampler port 21. In this embodiment, the pump tube 24 has a top end for carrying collected liquid to the surface above the borehole 10; there optionally may be provided a means for applying a vacuum to the top end of the pump tube 24 to draw the wetting front 4 into the mesh 20. The applied vacuum can also the lift sample liquids a short distance from the collection system to the ground's surface for testing.

Although the invention has been described in detail with particular reference to these preferred embodiments, other embodiments can achieve the same results. Variations and modifications of the present invention will be obvious to those skilled in the art and it is intended to cover with the appended claims all such modifications and equivalents. The entire disclosures of all patents cited above are hereby incorporated by reference as though fully set forth herein.

I claim:

1. A method for evaluating pore liquids in a geologic formation around a borehole, comprising the steps of:

providing at least one collection system upon a flexible liner;

disposing the flexible liner and collection system down the borehole;

disposing an injection tube down the borehole;

injecting a displacement fluid through the injection tube and into the formation;

creating with the displacement fluid a wetting front moving through the formation to carry pore liquids to the collection system;

allowing the collection system to collect liquids from the wetting front; and evaluating the collected liquids for chemicals therein.

2. The method of claim 1 wherein disposing the liner and collection system down the borehole comprises the step of everting, with the pressure of a fluid, the flexible liner down the borehole.

3. The method of claim 1 wherein providing at least one collection system comprises attaching an absorber to the liner.

4. The method of claim 3 further comprising the step of monitoring absorption of liquids into the absorber.

5. The method of claim 3 further comprising the steps of:

withdrawing the flexible liner and absorber from the borehole; and evaluating the absorber for liquids absorbed therein.

6. The method of claim 1 wherein disposing an injection tube down the borehole comprises the steps of:

disposing the injection tube within the liner interior;

providing a first injection port through the liner and in fluid communication with the injection tube; and injecting displacement fluid through the first injection port.

7. The method of claim 6 further comprising providing a spacer between the liner and the formation substantially proximate to the port.

8. The method of claim 7 further comprising the steps of:

locating the first injection port and the absorber on approximately diametrically opposite sides of the liner; and injecting displacing fluid through the first injection port to cause the wetting front to move circumferentially around the periphery of the borehole toward the absorber.

9. The method of claim 8 further comprising creating a wetting front that moves around both sides of the borehole to approach the absorber from two directions.

10. The method of claim 6 further comprising the steps of:

providing a second injection port through the liner;

locating the collection system between the first injection port and the second injection port; and injecting displacement fluid through the second injection port and into the formation;

wherein creating with the displacement fluid a wetting front moving through the formation to carry pore liquids to the collection system comprises the step of creating two wetting fronts converging toward the collection system.

11. The method of claim 10 wherein the formation is saturated, and locating the collection system comprises the further steps of:

providing a permeable spacer around the liner;

defining a sampler port through the liner in the vicinity of the permeable spacer;

placing a pumping system in fluid communication with the sampler port; and pumping collected liquid out of the borehole for evaluation;

wherein allowing the collection system to collect liquids comprises allowing pore liquids to flow into the pumping system via the sampler port.

12. The method of claim 11 further comprising the steps of:

providing a pump tube having a top end for carrying collected liquid; and applying a vacuum to the top end of the pump tube.

13. An apparatus for evaluating ambient pore liquids in a geologic formation around a borehole, comprising:

at least one collection system upon a flexible liner everted down the borehole; and tube means, disposed down the borehole, for injecting a displacement fluid into the formation to create, with the displacement fluid, a wetting front to carry pore liquids to the collection system;

wherein the collection system collects liquids from the wetting front, thereby allowing evaluation of the collected liquids for any chemicals therein.

14. An apparatus according to claim 13 wherein the at least one collection system comprises an absorber on the liner, and wherein further the flexible liner and absorber may be withdrawn from the borehole to permit evaluation of liquids absorbed in the absorber.

15. An apparatus according to claim 13 further comprising means for monitoring absorption of liquids by the absorber.

16. An apparatus according to claim 15 wherein the means for monitoring absorption comprises:

contacts on the absorber for measuring electrical resistance between the contacts; and means for transmitting the measured resistance to the top of the borehole.

17. An apparatus according to claim 16 wherein said means for transmitting comprises conductive wire leads.

18. An apparatus according to claim 13 wherein the injection tube is disposed within the liner interior, and further comprising a first injection port, through the liner and in fluid communication with the injection tube, for injecting displacement fluid into the formation.

19. An apparatus according to claim 18 further comprising a spacer between the liner and the formation, substantially proximate to the port.

20. An apparatus according to claim 19 wherein the first injection port and the absorber are located on approximately diametrically opposite sides of the liner, and further wherein injecting displacing fluid through the first injection port causes the wetting front to move circumferentially around the periphery of the borehole toward the absorber.

21. An apparatus according to claim 20 wherein the wetting front moves around both sides of the borehole to approach the absorber from two directions.

22. An apparatus according to claim 18 further comprising a second injection port through the liner for injecting displacement fluid into the formation, and wherein the collection system is located between the first injection port and the second injection port; and wherein a wetting front moving through the formation to carry pore liquids to the collection system comprises two wetting fronts converging toward the collection system.

23. An apparatus according to claim 22 wherein the formation is saturated, and further comprising:

a permeable spacer around the liner;

a sampler port through the liner in the vicinity of the permeable spacer;

a pumping system, in fluid communication with the sample port, for pumping collected liquid out of the borehole for evaluation;

wherein pore liquids flow into the pumping system via the sampler port.

24. An apparatus according to claim 23 further comprising:

providing a pump tube having a top end for carrying collected liquid; and means for applying a vacuum to the top end of the pump tube.

* * * * *